US007254923B2

(12) United States Patent
Hioki et al.

(10) Patent No.: US 7,254,923 B2
(45) Date of Patent: Aug. 14, 2007

(54) PREFIXED ADVERTISEMENT STRUCTURE INTEGRATED WITH GLASS SASH WALL OF BUILDING

(75) Inventors: Masahiro Hioki, Tokyo (JP); Shuichi Saito, Tokyo (JP); Mizuhiko Tamura, Tokyo (JP); Kanji Matsushita, Tokyo (JP)

(73) Assignee: Takenaka Corporation, Osaka-shi, Osaka (JP)

( * ) Notice: Subject to any disclaimer, the term of this patent is extended or adjusted under 35 U.S.C. 154(b) by 407 days.

(21) Appl. No.: 10/398,156

(22) PCT Filed: Sep. 13, 2001

(86) PCT No.: PCT/JP01/07953

§ 371 (c)(1),
(2), (4) Date: Apr. 1, 2003

(87) PCT Pub. No.: WO02/29771

PCT Pub. Date: Apr. 11, 2002

(65) Prior Publication Data

US 2004/0006929 A1 Jan. 15, 2004

(30) Foreign Application Priority Data

Oct. 5, 2000 (JP) ..... 2000-306722

(51) Int. Cl.
*E04H 1/00* (2006.01)

(52) U.S. Cl. ..... 52/235; 52/236.3

(58) Field of Classification Search ..... 52/235, 52/202, 474, 511, 236.3; 40/606.03, 611.01, 40/624, 544, 452, 550, 541
See application file for complete search history.

(56) References Cited

U.S. PATENT DOCUMENTS

| | | | | |
|---|---|---|---|---|
| 4,979,344 | A * | 12/1990 | Kusunoki | 52/235 |
| 5,333,428 | A * | 8/1994 | Taylor et al. | 52/235 |
| 5,347,779 | A * | 9/1994 | Jordan | 52/235 |
| 5,771,617 | A | 6/1998 | Baker | |
| 6,237,290 | B1 * | 5/2001 | Tokimoto et al. | 52/235 |
| 6,430,883 | B1 * | 8/2002 | Paz et al. | 52/235 |
| 6,442,911 | B2 * | 9/2002 | Elmer et al. | 52/235 |
| 6,578,340 | B2 * | 6/2003 | Ishikawa et al. | 52/235 |

(Continued)

FOREIGN PATENT DOCUMENTS

| | | |
|---|---|---|
| CN | 2174762 | 8/1994 |

(Continued)

*Primary Examiner*—Jose V. Chen
(74) *Attorney, Agent, or Firm*—patenttm.us; James H. Walters

(57) ABSTRACT

A prefixed advertisement structure which is positioned mainly in downtown areas or places of heavy traffic, belonging to the field of advertisement making effective use of the wall surfaces of a building (1) conspicuous to passersby, etc. and which, in particular, is integrated with a glass sash wall (2) of a building (1). A prefixed advertisement structure integrated with a glass sash wall (2) of a building (1), wherein a advertising site is secured in advance on wall surface of the building in consideration of harmony with the external design of the building (1), providing a source of income from advertisement from the time of completion of the building (1) with an advertising medium attached in advance, and the advertisement structure harmonized with the external design of the building prevents the external appearance of the building (1) from being spoiled and attracts people's attention, thus proving increased advertising effects.

2 Claims, 5 Drawing Sheets

U.S. PATENT DOCUMENTS

| | | | | |
|---|---|---|---|---|
| 6,804,920 | B2 * | 10/2004 | Hogan | 52/235 |
| 6,857,233 | B2 * | 2/2005 | Farag | 52/235 |

FOREIGN PATENT DOCUMENTS

| | | |
|---|---|---|
| CN | 1216592 | 5/1999 |
| EP | 997865 | 5/2000 |
| JP | 48-87795 | 11/1973 |
| JP | 51-42787 | 10/1976 |
| JP | 8-338095 | 12/1996 |

* cited by examiner

PREFIXED ADVERTISEMENT STRUCTURE INTEGRATED WITH GLASS SASH WALL OF BUILDING

TECHNICAL FIELD

The present invention relates to a pre-fixed advertisement structure which belongs to the field of advertising that makes effective use of the wall surface of a building located mainly in a downtown area or a place of heavy traffic, and conspicuous to passers-by, etc., and, in particular, to a pre-fixed advertisement structure integrated with a glass sash wall of such building.

BACKGROUND ART

When a building that is located in a downtown area or a place of heavy traffic and conspicuous to passers-by, etc., is put to use for advertisement, significant income can be expected from the advertisement. This is very attractive for building owners.

Conventionally, in order to use a building for advertisement, only so-called post-fixing methods, such as building an advertising tower on the roof of a building, attaching an advertising hanging from the roof of a building along one of its wall, attaching a TV screen to a wall surface of a building and the like, can be used.

In other words, in conventional advertising using buildings, generally only such post-fixing methods are available, i.e., setting an advertising medium at a place chosen as suitable when need arises, on a temporary basis. Thus, building owners obtain advertisement income only when a person or company who wishes to place an advertisement offers to enter into a contract for such advertisement with the building owner. This means that advertisement income is irregular and uncertain, so that it is difficult for building owners to budget such income.

Further, because of the post-fixing approach, it is difficult to avoid using an advertisement medium the original design of which does not match the design of the building. For example, when an advertising tower is built on the roof of a building, the advertising tower typically looks like an unmatching addition to the building design. A more serious drawback is that the height of the advertising tower may be too tall for passers-by, so that the passers-by do not see it easily. An advertising hanging hung from a building is, for people inside the building, just an obstacle swaying in the wind and hindering their sight. Also, for outside passers-by, an advertising hanging twisted by the wind or hanging down limply may not be easy to see. In addition, because of its large vertical length, the advertising effectiveness of the advertising hanging is questionable, and it also spoils the external design of a building. A TV screen attached to a wall surface of a building is a post-fixed structure protruding from the wall surface to quite a large extent. Thus, it is unavoidable that it looks haphazard.

The object of the present invention is to provide a pre-fixed advertisement structure integrated with a glass sash wall of a building, in which the advertising site is secured in advance on the wall surface of the building, in harmony with the external design of the building, and the advertising medium immediately set up so that advertisement income can be obtained from the time the building is completed. In the present invention, the advertisement structure is integrated with the building design and does not spoil the external appearance of the building, it can be easily located at a level that is easily seen by passers-by and can easily attract their attention, thus providing enhanced effectiveness for the advertising.

DISCLOSURE OF THE PRESENT INVENTION

In order to achieve the above object, the present invention as recited in claim 1 is a pre-fixed advertisement structure integrated with a glass sash wall of a building with the following characteristics. The structure is comprised of a recess of a size, shape and depth corresponding to the advertising board to be used, and is formed in the glass sash wall of the building at a location on the wall conspicuous to people on the street. The circumference and bottom of the recess is formed of fireproof boards that are reinforced with furring strips or the like on the interior side. The advertising board is fitted into the recess and is fixed to the furring strips or the like, with bolts or similar device.

The present invention as recited in claim 2 is a pre-fixed advertisement structure integrated with a glass sash wall of a building in accordance with claim 1 with the following characteristics. An inner wall of a color that highlights the advertising board fitted in the recess is provided on the interior side relative to the recess formed in the glass sash wall of the building.

The present invention as recited in claim 3 is a pre-fixed advertisement structure integrated with a glass sash wall of a building in accordance with claim 1 or 2 with the following characteristics. The recess is of a size to cover multiple floors of the building, and the front face of the advertising board fitted in the recess is nearly flush with the surface of the glass sash wall of the building.

BEST MODE OF CARRYING OUT THE PRESENT INVENTION

Figure 1:
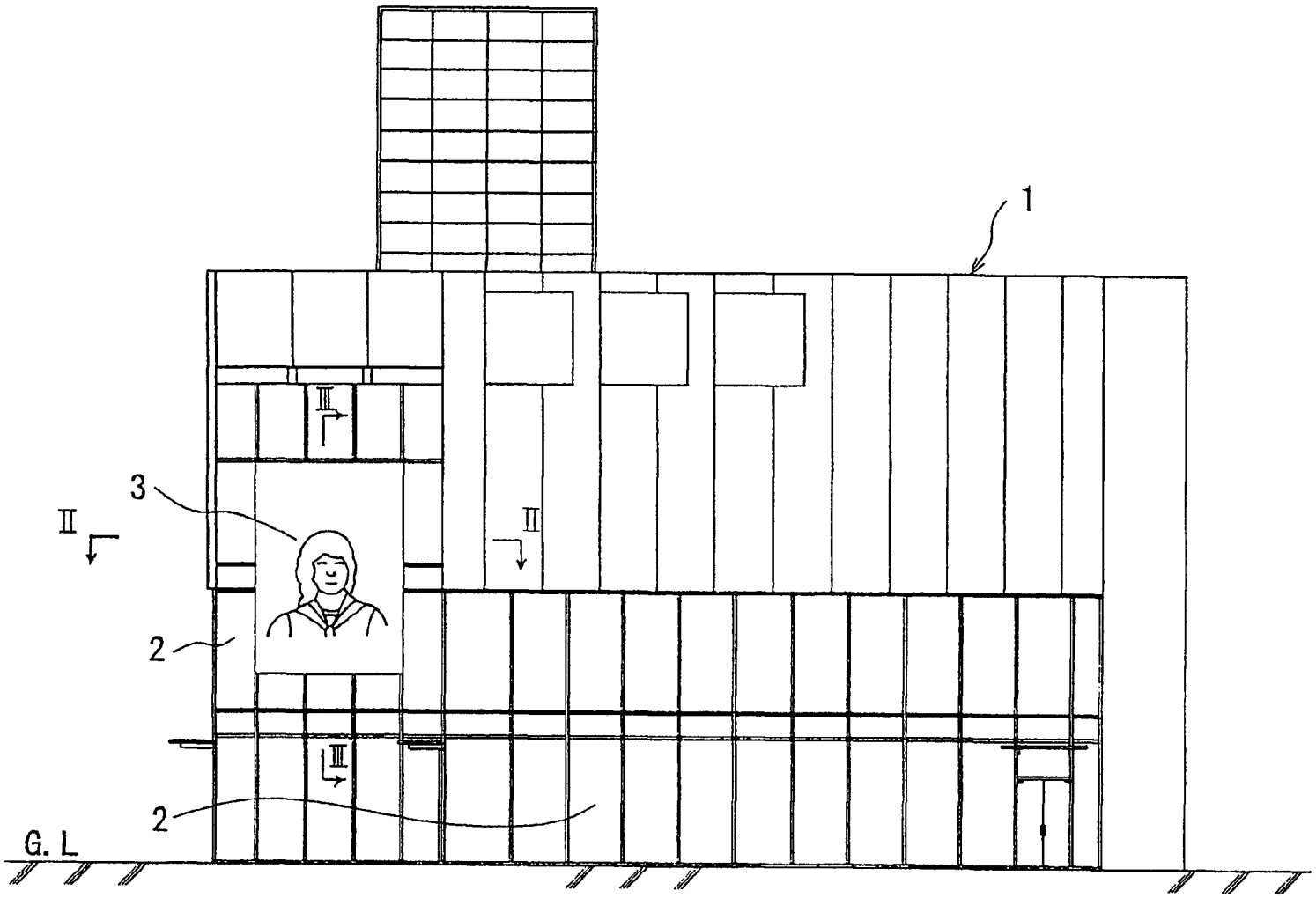
FIG. 1 is a perspective view of a building wherein an advertisement structure according to the present invention is provided.

FIG. 1 shows an embodiment of the present invention recited in claim 1, in which a region of a glass sash wall 2 of a building 1, which region is conspicuous to passers-by on the street, etc., that is, a region of appropriate height to be viewed by passers-by and of appropriate width, is selected, and a recess of a size, shape and depth suitable for fitting an advertising board 3 is formed in the selected region.

The advertising board 3 in the glass sash wall 2 of the building 1 shown in FIG. 1 is of a rectangular shape in which the vertical sides are longer than the horizontal sides. More specifically, it has a vertical height covering the second and third floors of the building (for example, about 6.7 m) and a horizontal width covering three glass-sash pitches (for example, about 5 m). The depth of the recess 4 in which the advertising board 3 is fitted is, for example, 500 mm.

Figure 2:
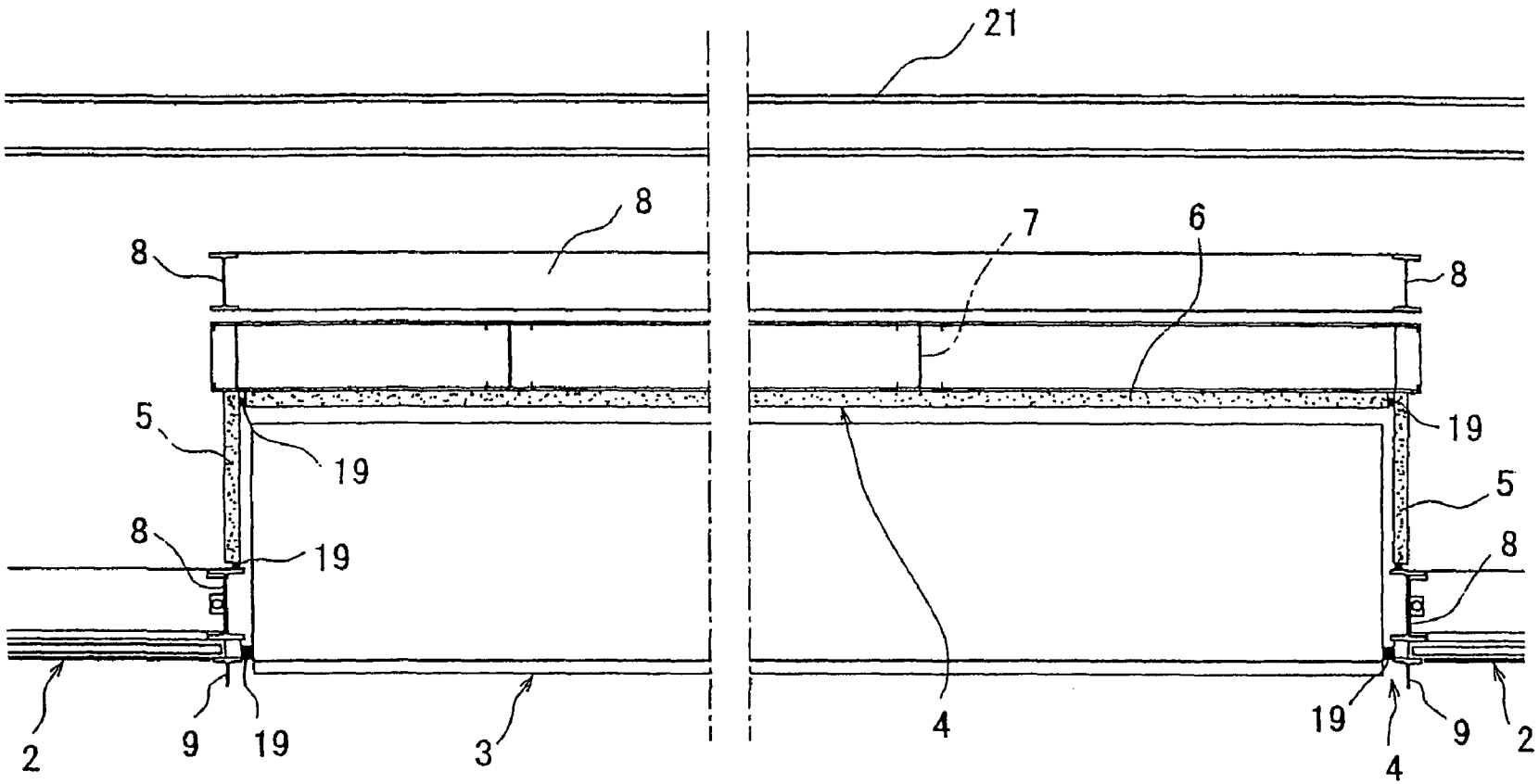
FIG. 2 is a cross-sectional view taken along line II-II in FIG. 1.
Figure 3:
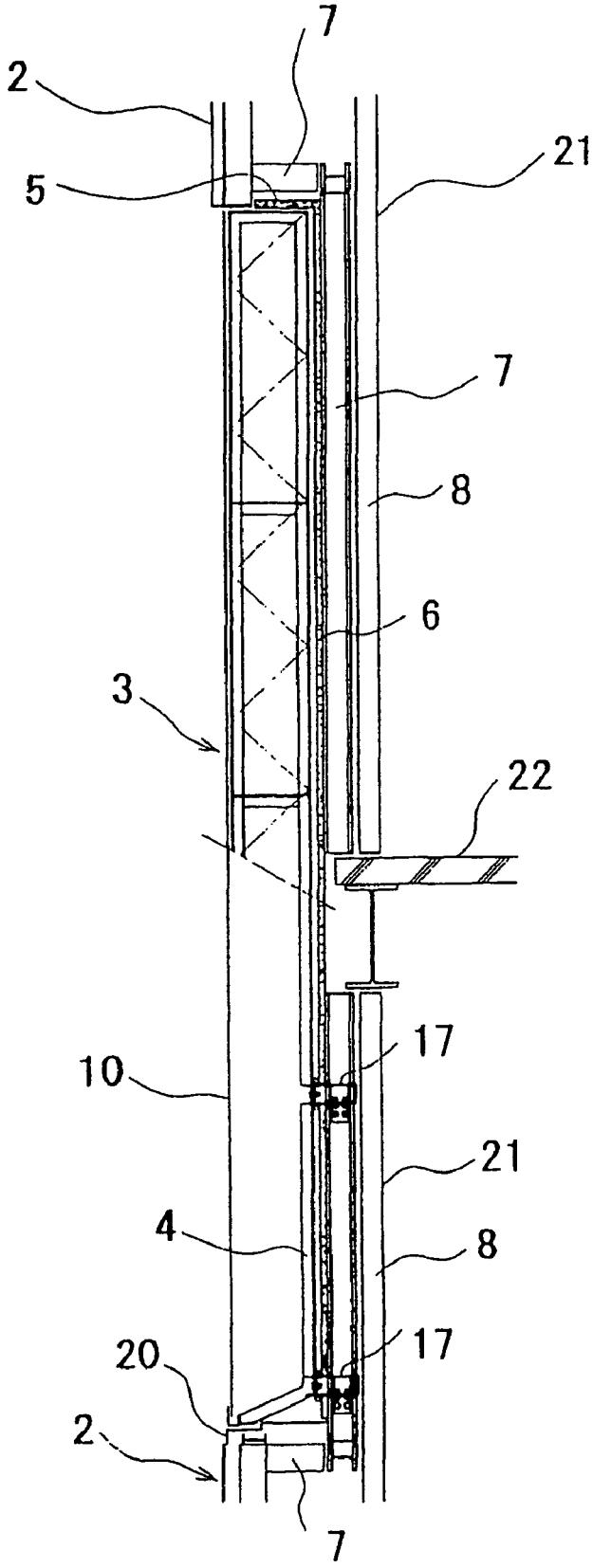
FIG. 3 is a cross-sectional view taken along line III-III in FIG. 1.

FIGS. 2 and 3 show a specific portion of the structure of the recess 4 into which the advertising board 3 is fitted. The circumference and bottom of the recess 4 is formed of fireproof boards 5 and 6. The fireproof boards 5 and 6 are fitted in a securely reinforced manner such that the fireproof boards 5 and 6 are bolted in spots to furring strips 7 arranged on the interior side (building side) relative to the fireproof boards 5 and 6. The furring strips 7 are connected in spots to steel-beam structures 8 arranged on the inner side relative to the furring strips 7. The glass sash wall 2 is constructed by fitting cut tees 9 to the front faces of steel-beam structures 8 arranged on the window side. Reference numeral 22 in FIG. 3 denotes a floor slab for the third floor of the building.

Figure 4:
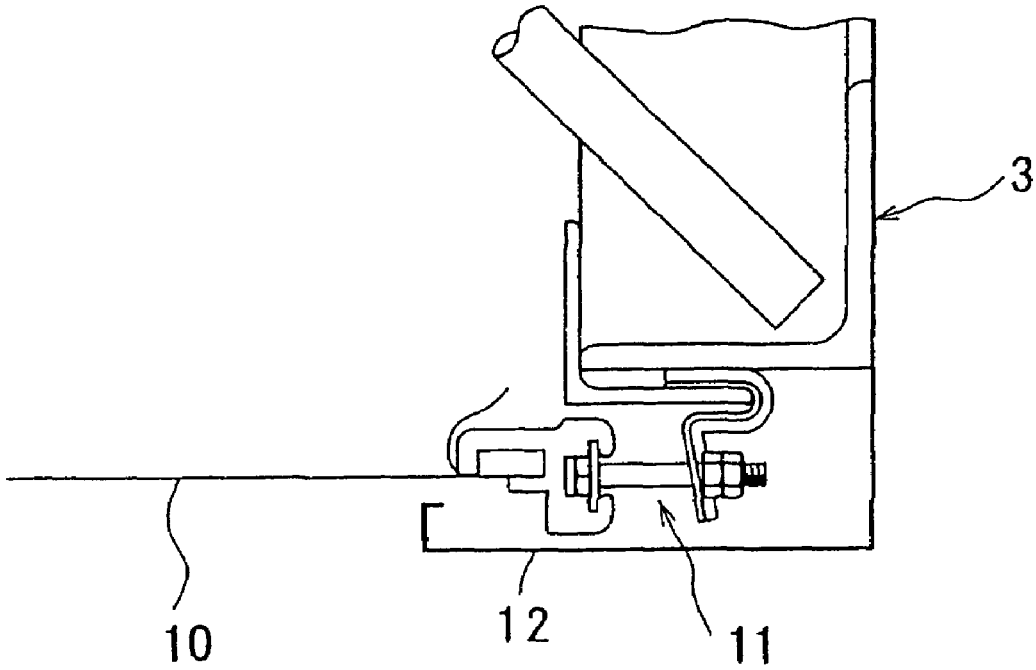
FIG. 4 is cross-sectional view showing a part of an advertising board on an enlarged scale.

The advertising board 3 fitted into the recess 4, for which a detailed illustration is omitted, is a strong structure constructed of steel-beam members, more specifically, a panel-like body made of steel-beam members organized into truss structure or the like. The shape, size, and thickness of the panel-like body are the same as the shape, size and depth of the recess 4, respectively. As shown in FIG. 4, along the front of the panel-like body constructed of steel-beam members, a base sheet 10 of a fire-and weather-proof material bearing a commercial copy, a photograph and/or the like, produced by printing or the like, is detachably fitted into a sufficiently tensioned, tightly stretched state by means of thread-type clamp devices 11. Reference numeral 12 in FIG. 4 denotes an exterior member formed of a stainless steel plate, which is commonly called an architrave. Although a specific illustration is omitted, night-time lighting equipment for illuminating from behind the base sheet 10 bearing a commercial copy, a photograph and/or the like, can make the commercial copy, photograph and/or the like more easily visible, and audio equipment, electric wiring, equipment for electrical connection to the building, etc. can be provided integrally with the advertising board 3.

The advertising board 3 of the above-described structure is fitted into the recess 4 and firmly fixed, making use of the furring strips 7, etc., from the interior side of the building. Specifically, the advertising board 3 is, for example, bolted in spots, as exemplified in FIGS. 5 and 6.

Figure 5:
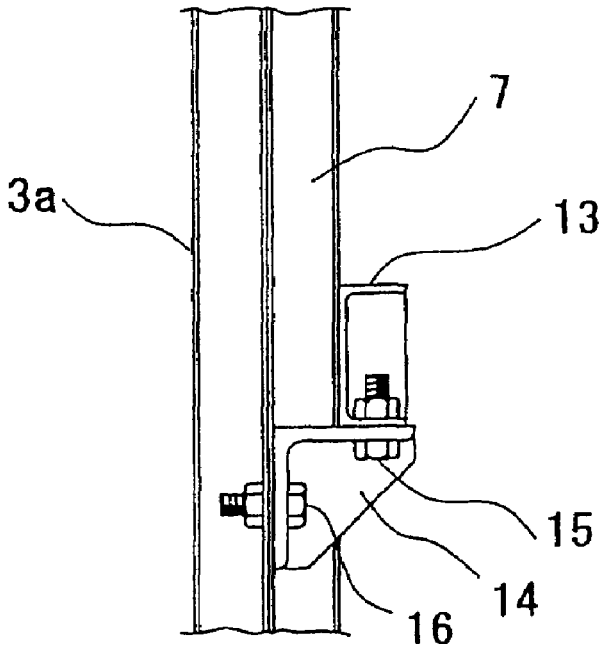
FIG. 5 is an illustration showing an advertising-board fixing means.

In the structure shown in FIG. 5, an angle bracket 14 is fastened to a crossbar 13 fixed to the furring strip 7, with high-tensile bolts 15, and the steel beam 3*a* of the advertising board 3 is made to abut the bracket 14 and be fastened to it, also with high-tensile bolts 16.

Figure 6:
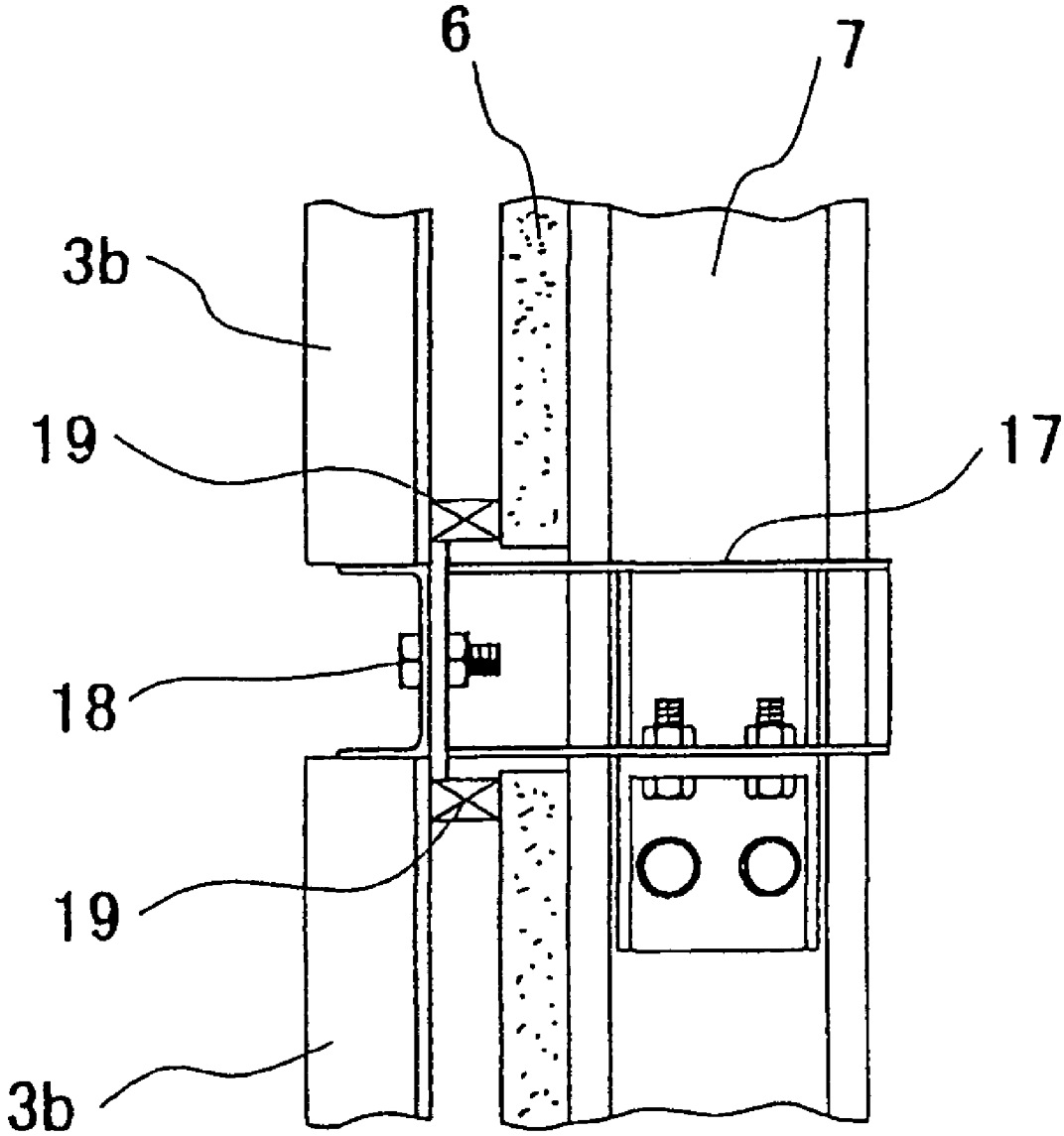
FIG. 6 is an illustration showing another example of an advertising-board fixing means.

In the structure shown in FIG. 6, a steel beam 3*b* of the advertising board 3 is fastened, also with high-tensile bolts 18, to a fastener 17 which is horizontally bolted to the furring strip 7. In the structure shown in FIG. 6, caulking material 19, which functions also as back-up material, is provided in a space between the advertising board 3 and the fireproof board 6 for weathering. The use of caulking material 19 or the like for weathering is also shown in FIG. 2.

In the structure shown in FIG. 3, an architrave 20 formed of a stainless steel plate is attached to the lower side of the recess 4 for weathering purposes.

One feature of the present invention is that, because of the above-described structure, when the advertising board 3 is pre-fixed to the glass sash wall 2 of the building 1 and integrated with it by fitting the advertising board 3 into the recess 4 formed in the glass sash wall 2, the front face of the advertising board 3 is nearly flush with the surface of the glass sash wall 2 of the building. Thus, people who see the building from the outside have an impression of harmonized integrity, (See FIGS. 2 and 3, and the present invention as recited in claim 3 ). Since the external design of the building 1 and the advertising board 3 are integrated, the advertisement attracts more attention, and the effectiveness of the advertising is increased.

Another feature of the present invention for increasing the effectiveness of the advertising is an inner wall 21 of a color that highlights the presence of the advertising board 3 as a background. The inner wall 21 is located on the interior side relative to (the advertising board 3) the recess 4 (inside the building). The inner wall 21 does not need to be a solid structure but can be anything with like effect, such as a drop curtain.

INDUSTRIAL APPLICABILITY

In the pre-fixed advertisement structure integrated with a glass sash wall of a building according to the present invention as recited in claims 1 to 3, harmony with the external design of the building is taken into consideration, a place appropriate for best attracting the attention of passers-by is secured as an advertising site on the glass sash wall of the building in advance, and an advertising medium is pre-fixed to the wall so that advertisement income can be obtained from the time the building is completed. The advertisement structure integrated with the external design of the building does not spoil the external appearance of the building, attracts people's attention to the advertisement itself, and increases the effectiveness of the advertising. Hence, the advertisement structure contributes to increased effectiveness of the advertisement and increased income, while maintaining harmony of design.

The invention claimed is:

1. A pre-fixed advertisement structure integrated with a glass sash wall of a building, wherein a recess (4) having a size, shape and depth corresponding to an advertising board (3) is formed in said glass sash wall (2) of said building (1), in a region conspicuous to people on an adjacent street, a circumference and bottom of said recess (4) is formed of fireproof boards (5), (6), said fireproof boards being reinforced with furring strips (7) on an interior side thereof, and said advertising board (3) fitted in said recess (4) is fixed to said furring strips (7) by bolting wherein said recess (4) is formed having a size covering multiple floors of said building (1), and a front face of said advertising board (3) fitted in said recess (4) is nearly flush with the surface of said glass sash wall (2) of said building (1).

2. A pre-fixed advertisement structure integrated with a glass sash wall of a building, wherein a recess (4) having a size, shape and depth corresponding to an advertising board (3) is formed in said glass sash wall (2) of said building (1), in a region conspicuous to people on an adjacent street, a circumference and bottom of said recess (4) is formed of fireproof boards (5), (6), said fireproof boards being reinforced with furring strips (7) on an interior side thereof, and said advertising board (3) fitted in said recess (4) is fixed to said furring strips (7) by bolting, wherein an inner wall (21) of a color that highlights said advertising board (3) fitted in said recess (4) is provided on an interior side relative to said recess (4) formed in said glass sash wall (2) of said building (1), and wherein said recess (4) is formed having a size covering multiple floors of said building (1), and a front face of said advertising board (3) fitted in said recess (4) is nearly flush with the surface of said glass sash wall (2) of said building (1).

* * * * *